US007928825B2

(12) United States Patent
Yang

(10) Patent No.: US 7,928,825 B2
(45) Date of Patent: Apr. 19, 2011

(54) SAFETY PLUG

(76) Inventor: Yung-Shan Yang, Taoyuan (TW)

( * ) Notice: Subject to any disclaimer, the term of this patent is extended or adjusted under 35 U.S.C. 154(b) by 0 days.

(21) Appl. No.: 12/654,132

(22) Filed: Dec. 11, 2009

(65) Prior Publication Data

US 2010/0167596 A1 Jul. 1, 2010

(30) Foreign Application Priority Data

Dec. 31, 2008 (CN) ..... 2008 20 206856 U

(51) Int. Cl.
*H01H 71/16* (2006.01)

(52) U.S. Cl. ..... 337/68; 439/604; 439/696

(58) Field of Classification Search ..... 337/68, 337/66, 381; 439/604, 696, 620.08
See application file for complete search history.

(56) References Cited

U.S. PATENT DOCUMENTS

| | | | | |
|---|---|---|---|---|
| 1,857,900 | A * | 5/1932 | Walder | 337/374 |
| 3,386,061 | A * | 5/1968 | Delafrange | 337/1 |
| 4,100,522 | A * | 7/1978 | Waszmer | 337/68 |
| 5,001,450 | A * | 3/1991 | Wu | 337/68 |
| 5,157,369 | A * | 10/1992 | Yao | 337/68 |
| 5,248,954 | A * | 9/1993 | Chiang | 337/66 |
| 7,258,580 | B1 * | 8/2007 | Ho et al. | 439/668 |
| 7,666,033 | B1 * | 2/2010 | Fung | 439/620.26 |

* cited by examiner

*Primary Examiner* — Neil Abrams
(74) *Attorney, Agent, or Firm* — Rosenberg, Klein & Lee

(57) ABSTRACT

A safety plug, comprising: a housing ·a first metal blade ·a second metal blade ·a conducting device ·a bimetallic strip ·an isolating-equipment ·an elastomer ·a cover and an isolator, wherein all of its apparatus are all well-located even after encountering overloading. Both the bimetallic strip and the conducting device are fixed together in the housing of the safety plug thus makes sure that their restoring back at the same exact location. It increases the safety and the practical utility of the safety plug in this way.

5 Claims, 7 Drawing Sheets

SAFETY PLUG

BACKGROUND OF THE INVENTION

1. Field of the Invention

The present invention relates to a plug, in particular to a safety plug with positioned components thereof.

2. Description of the Related Art

Unless otherwise indicated herein, the elements described in this section are not prior art to the claims in this application and are not admitted to be prior art by inclusion in this section.

The electricity is now everywhere around our living life, such as a television, a refrigerator, a computer and so on. With depending more and more closely on the electricity, the safety toward the plug becomes more and more important.

As discloses in R.O.C. Pat. No.268666, as shown in the FIG. 1A, a plug 1 includes a housing 111 and a cover (non shown). Between the housing 111 and the cover are two metal blade 112 ·113. One electrode 125*a* of the wire 125 reaches the housing 11*a* and contacts with the metal blade 113. One extremity of the other metal blade 112 forms a contact sheet 1126 where in a bimetallic strip 114 is fastened onto the contact sheet 1126. One extremity of the bimetallic strip 114 forms a contactor 1142 and beneath the contactor 1142 is a contact part 1162 of a conducting device 116 which fixed onto the housing 111. One extremity of the conducting device 116 is a hole 1164 ,using for contacting with another electrode 125*b* of the wire 125. A shaft 120 is disposed beneath the bimetallic strip 114 and the shaft 120 is made from isolated material. A isolating sheet 122 extrudes from the shaft 12. A spring 124 leans against the inner wall of the housing 111 and at the side of the isolating sheer 122. Thus, after the plug 1 is overloaded with electrical appliances, the contactor 1142 jumps. Based on the elasticity of the spring 124, the isolating sheet 122 would between the contractor 1142 of the isolating sheet 122 and the contractor 1162 of the conducting device 116. The plug cuts off the power supply then. To recover the electrified needs to press the shaft 120 down that causes the isolating sheet 122 removed from the between the bimetallic strip 114 and the conducting device 116. When the temperature descends, the contactor 1142 of the bimetallic strip 114 goes back to the same place where connects with the contractor 1142 of the bimetallic strip 114 and the contractor 1162 of the conducting device 116. Then, the plug returns to on working form.

However, the aforementioned conventional plug doesn't have any structure for fastening the shaft 120 ·bimetallic strip 114 and the conducting device 116. Also, the bimetallic strip 114 fasten on the contact sheet 1126 only by a rivet 1144. In this way results in many disadvantages:

First, the bimetallic strip 1126 is used to convert a temperature change in this case. It consists of two strips of different metals which have different thermal expansion and expand at different rates as they are heated. The bimetallic strip 1125 bends when heated. Thus, the sensitive requirement must be exact. The aforementioned conventional plug uses only a rivet to fasten the metal strip on the contact sheet 1126 without any connection on the housing thus easily causes the metal strip shifted after the temperature variation. The plug is not stable enough in this arrangement, so as the reliability.

Second, as shown in the FIG. 1B, the wire 125 reaches the housing 111 and make a contact with the metal blade 113 and the conducting device 116. However, the electrodes 125*a* and 125*b* of the wire 125 whirled around some components affects the bimetallic strip sometimes, especially when the wire 125 is pulled.

SUMMARY OF THE INVENTION

A primary objection of the present invention is to provide the safety plug that all of its apparatus are all well-located even after encountering overloading. The bimetallic strip also restores to the same location after it curves. In the present invention, both the bimetallic strip and the conducting device are fixed together in the housing of the safety plug thus makes sure that their restoring back at the same exact location. It increases the safety and the practical utility of the safety plug in this way.

Another objection of the present invention is to prevent the electric current from interacting in the housing. Also, it decreases the apparatus interacting when charging.

The other objection of the present invention is to provide a safety plug that the wire doesn't reach into the housing of the safety plug thus prevent from interfering with other apparatus of the safety plug. It helps to prolog the using life of all other apparatus, especially the bimetallic strip. Also, it increases the safety and the practical utility of the safety plug.

In order to achieve the above-mentioned objects, a safety plug in accordance with the invention comprises:

a housing, having a first surface, a second surface and a third surface, said the first surface and the second surface formed oppositely, said the third surface formed perpendicular to the first surface and the second surface, a groove formed between the first surface and the second surface, a first tank ·a second tank and a third tank formed respectively from the middle of the housing toward the first surface ·the second surface and the third surface;

a first metal blade, being disposed in the groove, one extremity of the first metal blade extending from the first surface thus forming an insertion part and the other extremity of the first metal blade extending from the second surface thus forming a first conductor;

a second metal blade, being disposed in the first tank, one extremity of the second metal blade extending from the first surface thus forming an insertion part and the other extremity of the second metal blade forming a depression with two holes perpendicular to the insertion part, one hole using for fixing the second metal blade onto the housing by a rivet and the other hole using for fixing a contactor;

a conducting device, being disposed in the second tank, one extremity of the conducting device forming a contacting part and the other part of the conducting device extending from the second surface forming a second conductor;

a bimetallic strip, one extremity of the bimetallic strip being disposed above the contactor and the other extremity of the bimetallic strip being disposed onto the conducting device through the holes of the bimetallic strip and the contacting part by the rivet thus the bimetallic strip being fixed on the vertical holes of the second tank fastening on the housing;

an isolating-equipment, being disposed in the third tank, one side of the isolating-equipment forming an insolating-sheet and the other side of the isolating-equipment extruding from the third surface thus forming a controller, said isolating-equipment forming a concave underneath;

an elastomer, being disposed in the concave, the extremities of the elastoemr leaning against on the inner side of the third tank and the concave;

a cover, covering the housing; and an isolator covers the first conductor and the second conductor to envelope the space for the safety plug and an outer wire electrified.

DETAILED DESCRIPTION OF THE PREFERRED EMBODIMENT

Figure 1A:
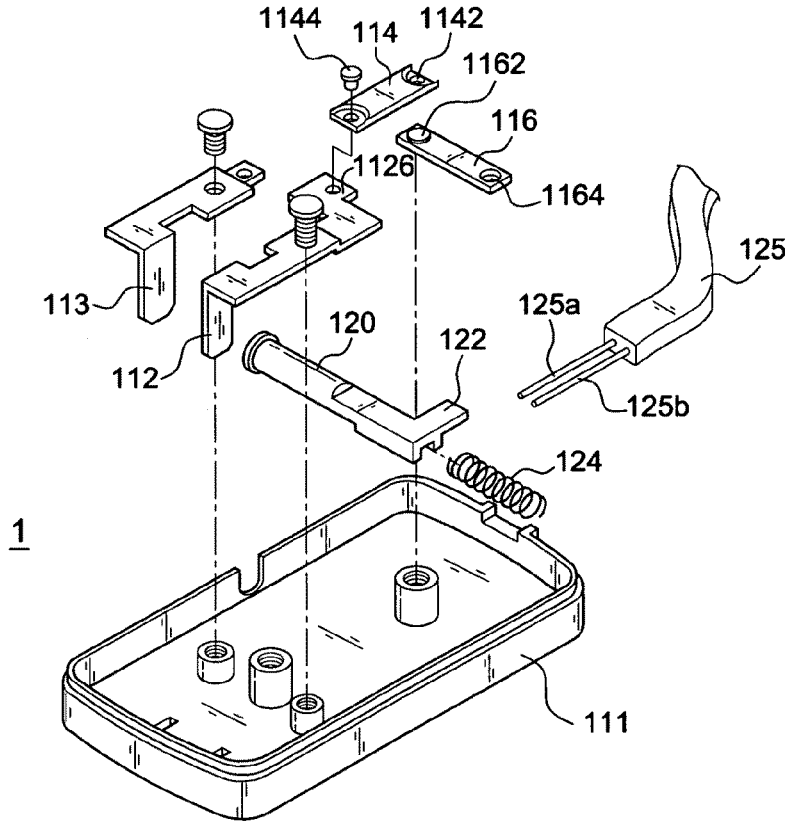
FIG.1A PRIOR ART
FIG. 1A~1B discloses in R.O.C. Pat. No. 268666.
Figure 1B:
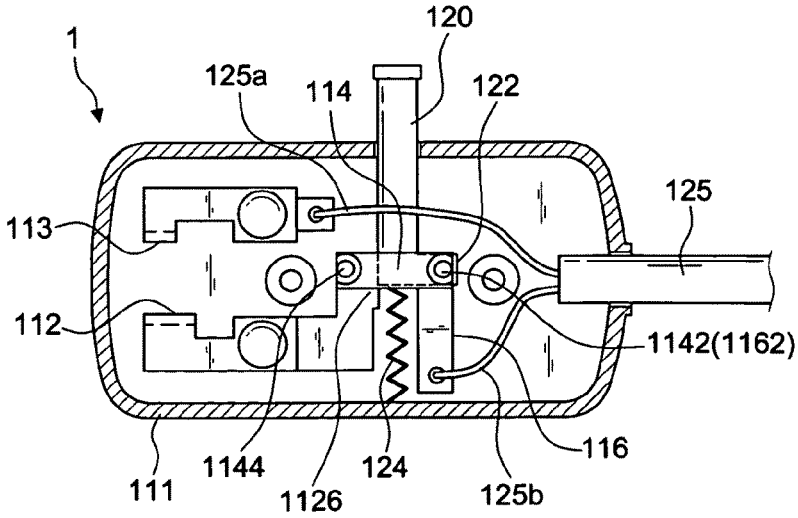
FIG.1B PRIOR ART
Figure 2:
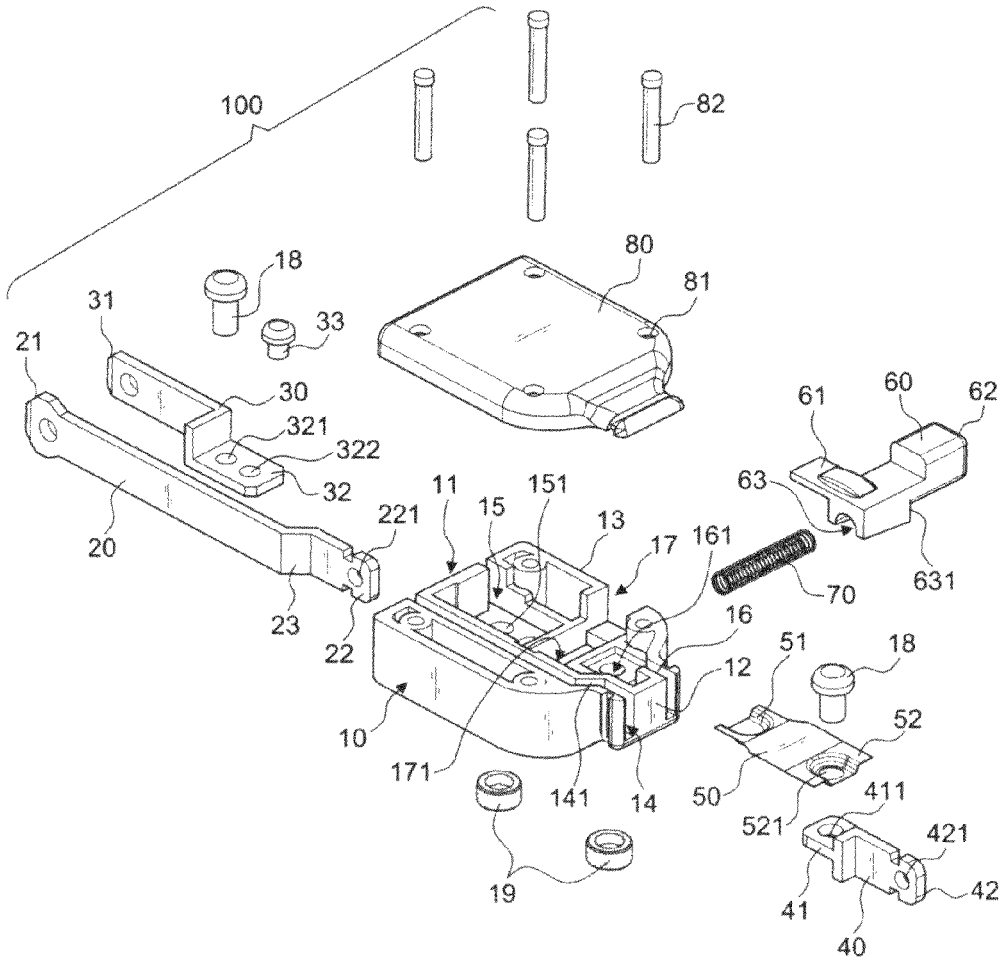
FIG. 2 is a exploded view of portion of the present invention.

Referring to FIG. 2, a safety plug 100 in accordance with the present invention is shown comprised of a housing 100, having a first surface 11, a second surface 12 and a third surface 13, said the first surface 11 and the second surface 12 formed oppositely, said the third surface 13 formed perpendicular to the first surface 11 and the second surface 12, a groove 14 formed between the first surface 11 and the second surface 12, a first tank 15 ·a second tank 16 and a third tank 17 formed respectively from the middle of the housing 10 toward the first surface ·11 the second surface 12 and the third surface 13; a first metal blade 20, being disposed in the groove 14, one extremity of the first metal blade 20 extending from the first surface 11 thus forming an insertion part 21 and the other extremity of the first metal blade 20 extending from the second surface 12 thus forming a first conductor 22; a second metal blade 30, being disposed in the first tank 15, one extremity of the second metal blade 30 extending from the first surface 11 thus forming an insertion part 31 and the other extremity of the second metal blade 30 forming a depression 32 with two holes 321 ·322 perpendicular to the insertion part 31, one hole 321 using for fixing the second metal blade 30 onto the housing 10 by a rivet 18 and the other hole 322 using for fixing a contactor 33; a conducting device 40, being disposed in the second tank 16, one extremity of the conducting device 40 forming a contacting part 41 and the other part of the conducting device 40 extending from the second surface 42 forming a second conductor 42; a bimetallic strip 50, one extremity 51 of the bimetallic strip 50 being disposed above the contactor 33 and the other extremity 52 of the bimetallic strip 50 being disposed onto the conducting device 40 through the holes 521 of the bimetallic strip 50 and the contacting part 41 by the rivet 18 thus the bimetallic strip 50 being fixed on the vertical holes 161 of the second tank 16 fastening on the housing 10, said the bimetallic strip 50 connected to the contactor 33 but still being shiftable; an isolating-apparatus 60, being disposed in the third tank 17, one side of the isolating-equipment forming an insolating-sheet 61 and the other side of the isolating-apparatus 60 extruding from the third surface 16 thus forming a controller 62, said isolating-apparatus 60 forming a concave 63 underneath; an elastomer 70, being disposed in the concave 63, the extremities of the elastoemr 70 leaning against on the inner side of the third tank 171 and the concave 631; and a cover 80 covers the housing 10.

Figure 3:
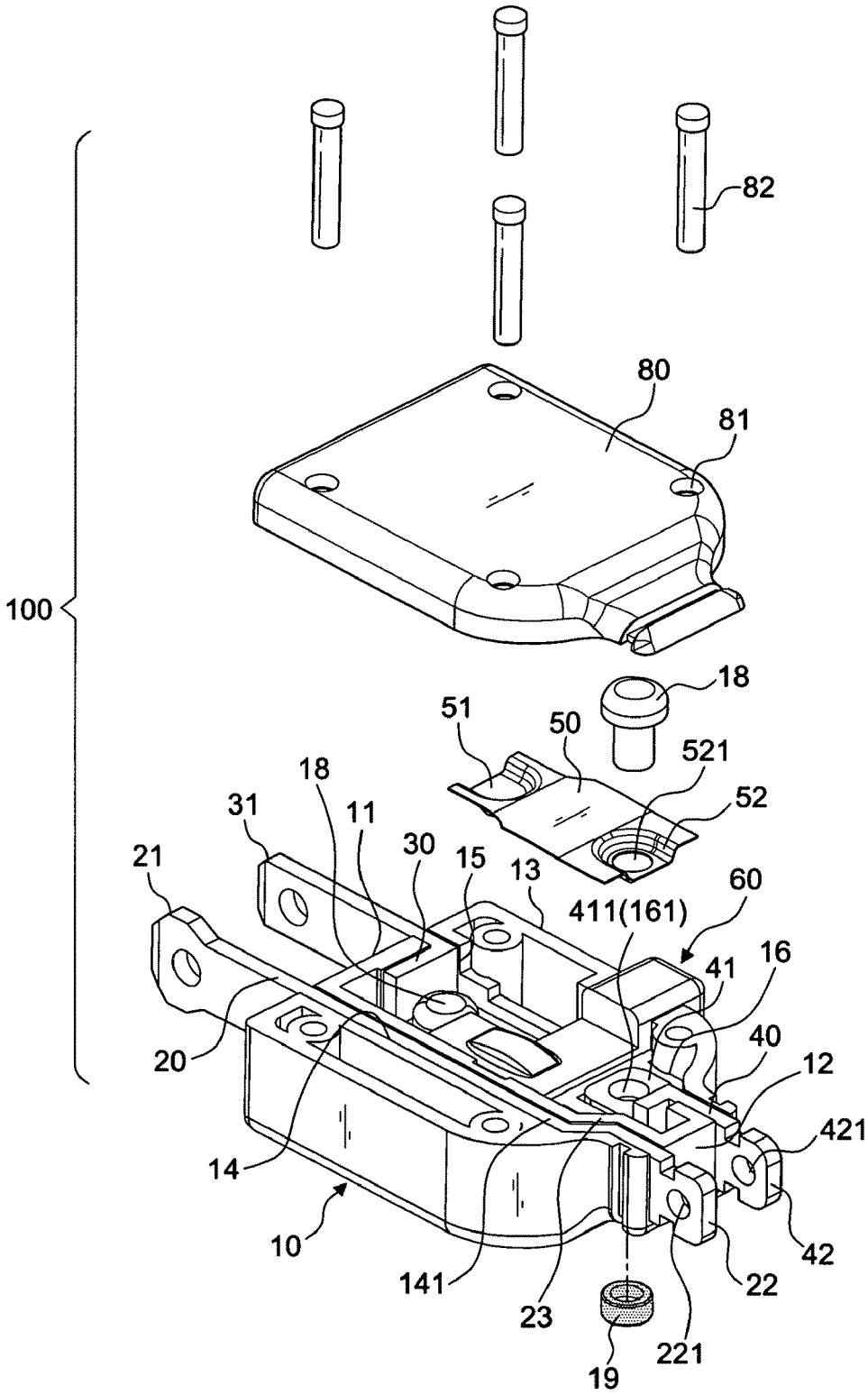
FIG. 3 is the assembly view of the present invention.
Figure 4:
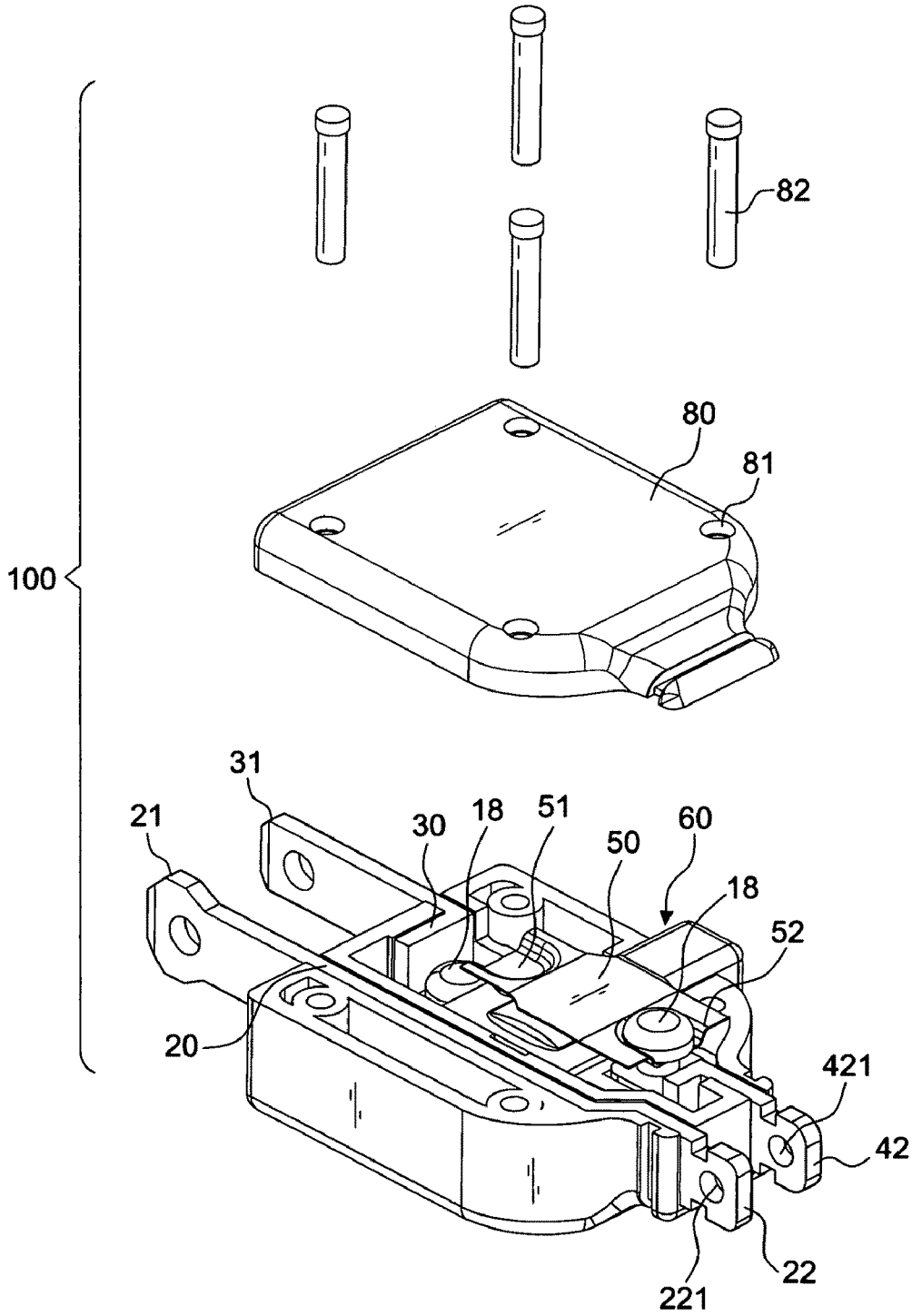
FIG. 4 is the assembly view of the present invention.
Figure 8:
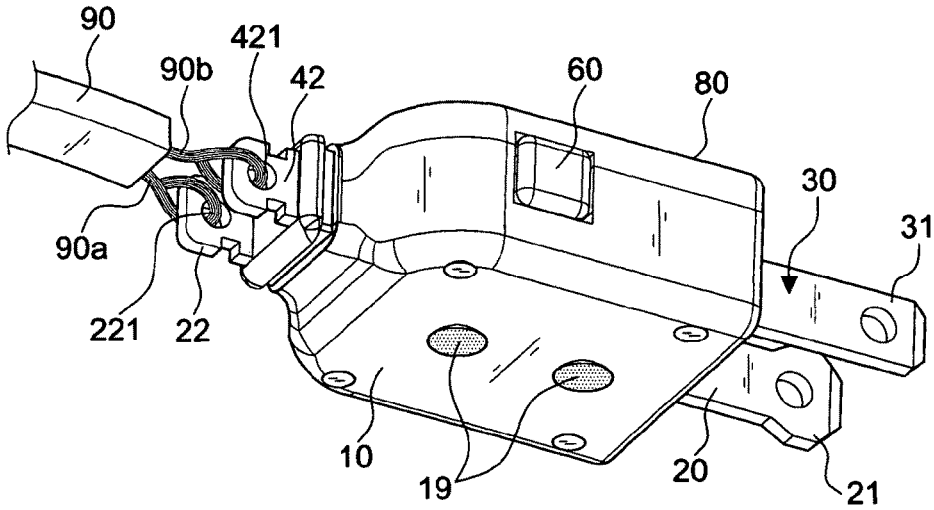
FIG. 8 represents a rear view of the present invention before installation of an isolator.

FIG. 3 to FIG. 4 represent the assembly view of the present invention. First, respectively installing the first metal blade 20 ·the second metal blade 30 and the conducting device 40 into the groove 14 ·the first tank 15 and the second tank 16, wherein the groove 14 forms a shrunk part 141 that being corresponded to a shrunk part 23 of the first metal blade 20 for avoiding the first metal blade 20 from sliding in the groove 14. Then, riveting the conducting device 40 and the bimetallic strip 50 through the hole 411 of the conducting device 40 and the hole 521 of the bimetallic strip 50 by the rivet 18. Thus the bimetallic strip 50 and the conducting device 40 are fixed on the vertical holes 161 of the second tank 16 fastening on the housing 10. With reference to FIG. 8 represent the safety plug 100 further comprises an isolating cap 19 cover beneath the housing for isolating the case 10 and makes exterior of the housing 10 smooth.

Figure 5:
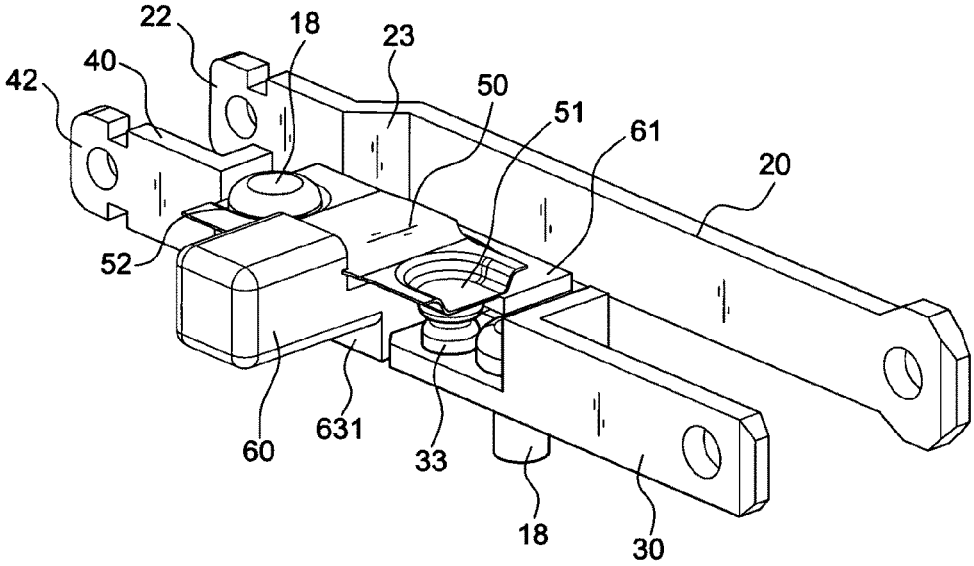
FIG. 5 represents a portion of the safety plug in a normal using situation.
Figure 6:
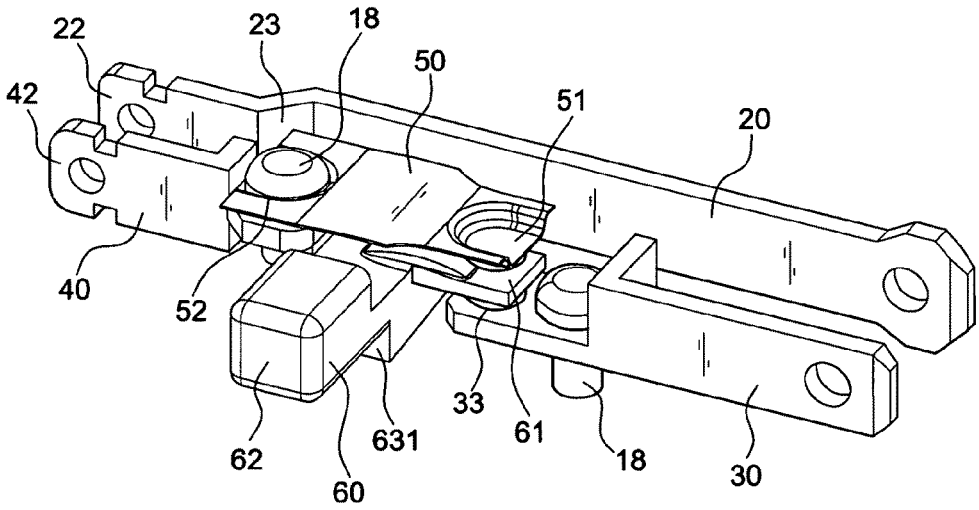
FIG. 6 represents a portion of the present invention under the overloading situation.

FIG. 5 represents a portion of the safety plug 100 in a normal using situation. An outer wire electrifies the first conductor 22 and the second conductor 42. The electrical circuit goes through the conducting device 40 ·the bimetallic strip 50 ·the first metal blade 20 and the second metal blade 30. FIG. 6 represents a portion of the safety plug 100 under the overloading situation. The bimetallic strip 50 curves toward the cover 80. Based on the elasticity of the elastomer 70, the isolating sheet 61 reaches into the space at once. In this way, the safety plug 100 is in a short circuit. To restore the safety plug 100 only needs to pressure the controller 62 thus the bimetallic strip 50 connects with the contactor 33 again, the safety plug 100 again in a normal using situation.

Figure 7:
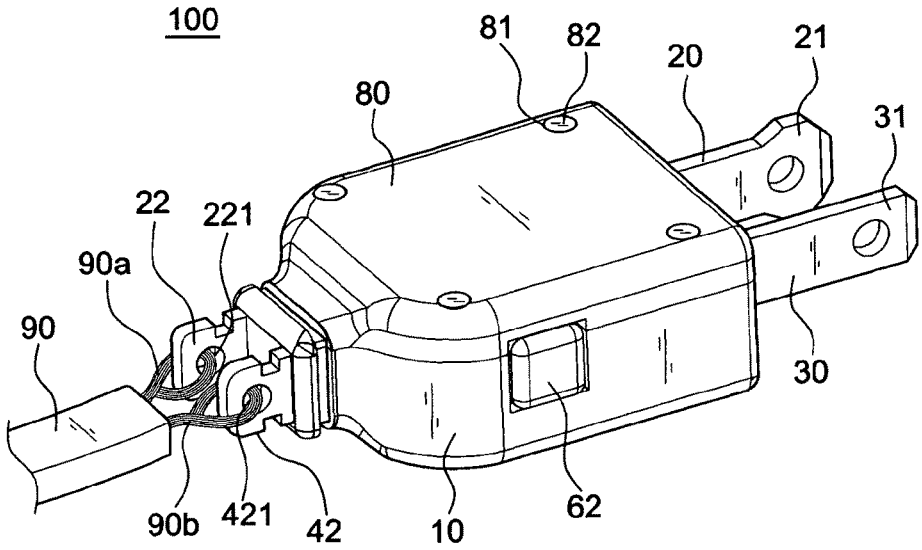
FIG. 7 represents an initial drawing showing of the present invention before installation of an isolator.

Referring to FIG. 7 represents an initial drawing showing of the present invention before installation of an isolator. It shows the cover 80 covers the housing 10 by a plurality of fixing elements 82 through a plurality of fixing holes 81, but not limited, such as adhesive, glues . . . etc.

In accordance with the present invention, the total volume of the safety plug 100 is the same as the conventional plug, however, the safety plug 100 provides a safety protection, especially when it encounters overloading. Moreover, the apparatus of the present invention are all well-located, especially the bimetallic strip 50 are fixed and exactly well-located even after the safety plug encountering overloading. Referring to the FIG. 7 shows the first conductor 22 and the second conductor 42 are extruded from the housing 10 and make connection with the first electric wire 90*a* and the second electric wire 90*b*. The first conductor 22 and the second conductor 42 respectively form a connecting hole 221 ·421 for an outer wire electricifing. The wire 90 doesn't reach into the housing 10 thus prevent from interfering with other apparatus of the safety plug 100. It helps to prolog the using life of all other apparatus, especially the bimetallic strip 50. Also, it increases the safety and the practical utility of the safety plug.

Referring to the FIG. 8 is the rear view of the present invention. The two isolating caps 19 for isolating the case 10 through the holes 151 ·161 (shown as FIG. 2) and make exterior of the housing 10 smooth. Its more artistic this way.

Figure 9:
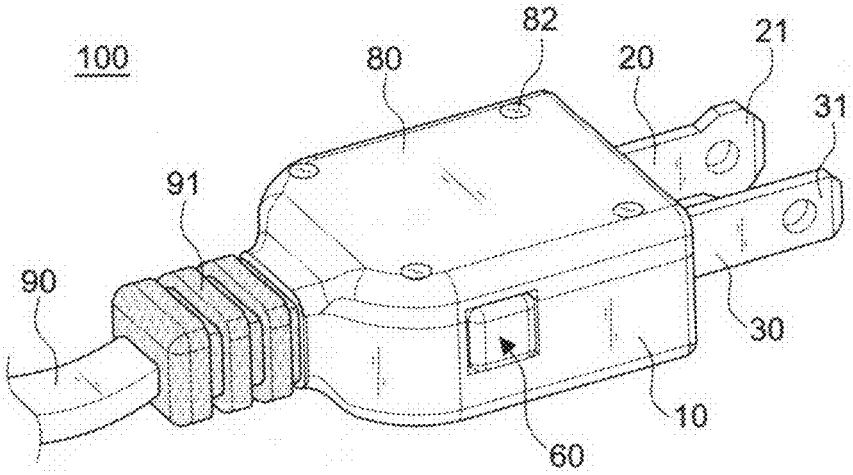
FIG. 9 is the schematic drawing showing of the present invention.

Referring to the FIG. 9 is the schematic drawing showing of the present invention. An isolator 91 covers the first conductor 22 and the second conductor 42 to envelope the space for the safety plug 100 and an outer wire electrified.

Figure 10:
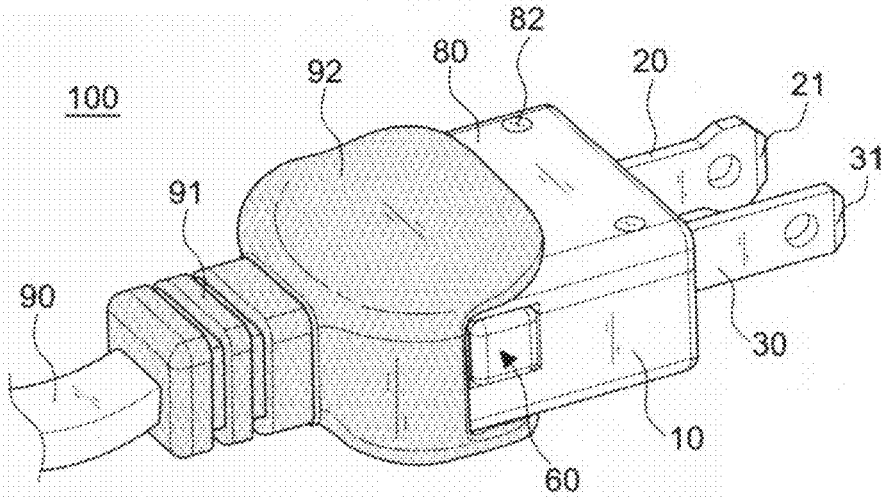
FIG. 10 is the schematic drawing showing of the present invention.

Referring to the FIG. 10 is the schematic drawing showing of the present invention. The isolator 91 covers the cover 80 and portion of the housing 10 thus forming an extruding surface 92. Its more safety and more artistic this way.

The groove 14 of the present invention forms the shrunk part 141 that being corresponded to the shrunk part 23 of the first metal blade 20 for avoiding the first metal blade 20 from sliding in the groove 14. It prevents the electric current from interacting in the housing. Also, it decreases the apparatus interacting when charging.

The apparatus of the safety plug are all well-located even after encountering overloading. The bimetallic strip also restores to the same location after it curves. It increases the safety and the practical utility of the safety plug.

Many changes and modifications in the above-described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A safety plug, comprising:

a housing, having a first surface, a second surface and a third surface, said first surface and said second surface formed oppositely, said third surface formed perpendicular to said first surface and said second surface, a groove formed between said first surface and said second surface, a first tank, a second tank and a third tank formed respectively from the middle of said housing toward said first surface, said second surface and said third surface;

a first metal blade, being disposed in said groove, one extremity of said first metal blade extending from said first surface thus forming an insertion part and the other extremity of said first metal blade extending from said second surface thus forming a first conductor;

a second metal blade, being disposed in said first tank, one extremity of said second metal blade extending from said first surface thus forming an insertion part and the other extremity of said second metal blade forming a depression with two holes perpendicular to said insertion part, one hole using for fixing said second metal blade onto said housing by a rivet and the other hole using for fixing a contactor;

a conducting device, being disposed in said second tank, one extremity of said conducting device forming a contacting part and the other part of said conducting device extending from said second surface forming a second conductor;

a bimetallic strip, one extremity of said bimetallic strip being disposed above said contactor and the other extremity of said bimetallic strip being disposed onto said conducting device through the holes of said bimetallic strip and said contacting part by said rivet thus said bimetallic strip being fixed on the vertical holes of said second tank fastening on said housing;

an isolating-equipment, being disposed in said third tank, one side of said isolating-equipment forming an insolating-sheet and the other side of said isolating-equipment extruding from said third surface thus forming a controller, said isolating-equipment forming a concave underneath;

an elastomer, being disposed in said concave, the extremities of the elastomer leaning against on the inner side of said third tank and said concave;

a cover, covering said housing; and an isolator covers said first conductor and said second conductor to envelope the space for said safety plug and an outer wire electrified.

2. The safety plug of claim 1, wherein said groove forms a shrunk part that being corresponded to a shrunk part of said first metal blade for avoiding said first metal blade from sliding in said groove.

3. The safety plug of claim 1, wherein said first conductor and said second conductor respectively form a connecting hole for an outer wire electrified.

4. The safety plug of claim 1, wherein said isolator covers said cover and portion of said housing thus forming an extruding surface.

5. The safety plug of claim 1, wherein said housing further comprises a plurality of isolating caps cover beneath.

* * * * *